US009435018B2

(12) United States Patent
Watanabe et al.

(10) Patent No.: US 9,435,018 B2
(45) **Date of Patent: *Sep. 6, 2016**

(54) METHOD FOR CARBURIZING TANTALUM CONTAINER

(75) Inventors: Masanari Watanabe, Osaka (JP); Yoshihisa Abe, Osaka (JP)

(73) Assignee: TOYO TANSO CO., LTD., Osaka (JP)

( * ) Notice: Subject to any disclaimer, the term of this patent is extended or adjusted under 35 U.S.C. 154(b) by 465 days.

This patent is subject to a terminal disclaimer.

(21) Appl. No.: 13/990,078

(22) PCT Filed: Jul. 6, 2011

(86) PCT No.: PCT/JP2011/065486

§ 371 (c)(1),
(2), (4) Date: May 29, 2013

(87) PCT Pub. No.: WO2012/073547

PCT Pub. Date: Jun. 7, 2012

(65) Prior Publication Data

US 2013/0240090 A1 Sep. 19, 2013

(30) Foreign Application Priority Data

Nov. 30, 2010 (JP) ..... 2010-266312

(51) Int. Cl.
*C23C 8/64* (2006.01)

(52) U.S. Cl.
CPC ..... *C23C 8/64* (2013.01)

(58) Field of Classification Search
CPC ..... C23C 8/64; C23C 8/20
USPC ..... 148/237, 223
See application file for complete search history.

(56) References Cited

U.S. PATENT DOCUMENTS 6,217,841 B1 * 4/2001 Grindatto et al. ..... 423/345
2004/0250921 A1 * 12/2004 Yamaguchi ..... 148/218

(Continued)

FOREIGN PATENT DOCUMENTS

JP 2005-68002 A 3/2005
JP 2008-16691 A 1/2008

(Continued)

OTHER PUBLICATIONS

English translation of Official Communication issued in corresponding International Application PCT/JP2011/065486, mailed on Jun. 13, 2013.

(Continued)

*Primary Examiner* — Jessee Roe
*Assistant Examiner* — Jenny Wu
(74) *Attorney, Agent, or Firm* — Keating and Bennett, LLP

(57) ABSTRACT

Provided is a method for carburizing a tantalum container which can easily control the carburization thicknesses of various portions of the tantalum container and carburize the tantalum container with a uniform thickness. A method for carburizing a tantalum container 1 made of tantalum or a tantalum alloy to allow carbon to penetrate the tantalum container 1 includes the steps of: supporting the tantalum container 1 on a support member 5, 6 provided in a chamber 3 and setting the tantalum container 1 in the chamber 3; and reducing the pressure inside the chamber 3 and heating the interior of the chamber 3, wherein a carbon source is placed in the vicinity of a portion of the tantalum container 1 hard to carburize.

7 Claims, 9 Drawing Sheets

(56) References Cited

U.S. PATENT DOCUMENTS

| | | | | |
|---|---|---|---|---|
| 2007/0059501 | A1 | 3/2007 | Kaneko et al. | |
| 2008/0073001 | A1* | 3/2008 | Katsumata | 148/223 |
| 2010/0284895 | A1 | 11/2010 | Kaneko et al. | |

FOREIGN PATENT DOCUMENTS

| | | | | |
|---|---|---|---|---|
| JP | 2008-81362 | A | | 4/2008 |
| JP | 2008081362 | A | * | 4/2008 |
| JP | 2009-242854 | A | | 10/2009 |
| JP | 2010-163302 | A | | 7/2010 |
| JP | 2010163302 | A | * | 7/2010 |

OTHER PUBLICATIONS

Official Communication issued in International Patent Application No. PCT/JP2011/065486, mailed on Oct. 4, 2011.

* cited by examiner

METHOD FOR CARBURIZING TANTALUM CONTAINER

TECHNICAL FIELD

This invention relates to methods for subjecting a tantalum container made of tantalum or a tantalum alloy to a carburizing treatment for allowing carbon to penetrate the container from its surface toward its inside.

BACKGROUND ART

Silicon carbide (SiC) is considered as capable of achieving high-temperature performance, high-frequency performance, voltage resistance, and environment resistance each of which could not be achieved by conventional semiconductor materials, such as silicon (Si) and gallium arsenide (GaAs), and is therefore expected as a semiconductor material for next-generation power devices and high-frequency devices.

Patent Literature 1 proposes to use a tantalum container having a tantalum carbide layer formed on the surface thereof as a chamber in thermally annealing the surface of a single crystal silicon carbide substrate and in growing a single crystal of silicon carbide on a single crystal silicon carbide substrate. The literature reports that by containing a single crystal silicon carbide substrate in a tantalum container having a tantalum carbide layer on the surface thereof and thermally annealing its surface or growing a silicon carbide single crystal on its surface, a single crystal silicon carbide substrate or a silicon carbide single crystal layer can be formed in which its surface is planarized and has less defects.

Patent Literatures 2 and 3 propose a carburizing method in which $Ta_2O_5$ as a naturally oxidized film existing on the surface of tantalum or a tantalum alloy is removed by sublimation and carbon is then allowed to penetrate the surface to form tantalum carbide on the surface.

However, the above methods present a problem in that in carburizing the workpiece in the chamber by reducing the pressure inside the chamber and heating the interior of the chamber, the gas in the chamber is exhausted by an evacuating pump to produce a gas flow in the chamber and carbon from the carbon source moves along the gas flow, so that the surface of the tantalum container cannot be uniformly carburized.

Furthermore, no specific proposal has been heretofore given of a method for uniformly carburizing the surface of a tantalum container.

CITATION LIST

Patent Literature

Patent Literature 1: JP-A-2008-16691
Patent Literature 2: JP-A-2005-68002
Patent Literature 3: JP-A-2008-81362

SUMMARY OF INVENTION

Technical Problem

An object of the present invention is to provide a method for carburizing a tantalum container which, although the tantalum container is set in a chamber and the chamber is reduced in pressure, can easily control the carburization thicknesses of various portions of the container and carburize the tantalum container with a uniform thickness.

Solution to Problem

A carburizing method of the present invention is a method for carburizing a tantalum container made of tantalum or a tantalum alloy to allow carbon to penetrate the tantalum container includes the steps of: supporting the tantalum container on a support member provided in a chamber and setting the tantalum container in the chamber; and reducing the pressure inside the chamber and heating the interior of the chamber, wherein a carbon source is placed in the vicinity of a portion of the tantalum container hard to carburize.

The vicinity of the portion of the tantalum container hard to carburize is preferably a distance of 0 to 50 mm, more preferably 0.5 to 50 mm, and still more preferably 5 to 50 mm from the portion. In the present invention, the portion of the tantalum container hard to carburize may be identified in advance by, prior to the step of placing the carbon source, reducing the pressure inside the chamber and heating the interior of the chamber to thereby carburize the tantalum container without provision of the carbon source.

In the present invention, an example of the tantalum container is one formed of a bottom part, a sidewall part, and an opening. Examples of the portion of this tantalum container hard to carburize include the inside surfaces of the bottom part and the sidewall part of the tantalum container. If the inside surfaces of the bottom part and the sidewall part of the tantalum container are the portions thereof hard to carburize, the carbon source is preferably placed in the interior of the tantalum container.

If the portion of the above tantalum container hard to carburize is a corner portion thereof formed by the inside surfaces of the bottom part and the sidewall part of the tantalum container, the carbon source is preferably placed in the vicinity of the corner portion.

In the present invention, the tantalum container is preferably set in the chamber to face the opening of the tantalum container downward. In this case, the tantalum container is preferably supported on the support member supporting the bottom part of the tantalum container from the inside.

In the present invention, the preferred carbon source for use is a carbon source having continuous open pores. An example of the carbon source having continuous open pores is a carbon foam.

The carbon foam for use as the carbon source having continuous open pores in the present invention is a carbon source having a reticulated form and therefore a large surface area. Therefore, a sufficient amount of carbon can be supplied to the desired portion of the tantalum container. Furthermore, the carbon foam can be easily processed into various shapes and thereby can be placed in any desired location inside the chamber. Therefore, by placing the carbon foam serving as the carbon source in the vicinity of the portion of the tantalum container desired to promote a carburizing treatment, the carburizing treatment of the desired portion can be promoted. Hence, the carburization thicknesses of various portions of the tantalum container can be easily controlled.

In the present invention, the chamber and the support member are preferably made of a carbon source. An example of the carbon source in this case is a carbon material, such as graphite. Each of the chamber and the support member may be at least partly a carbon source and, as for the chamber, the inside surface thereof, i.e., the inside wall, is preferably a carbon source.

Advantageous Effects of Invention

By placing a carbon source in the vicinity of the portion of the tantalum container hard to carburize in accordance with the present invention, the carburization thicknesses of various portions of the tantalum container can be easily controlled and the tantalum container can be carburized with a uniform thickness.

DESCRIPTION OF EMBODIMENTS

Hereinafter, the present invention will be described with reference to more specific examples; however, the present invention is not limited by the following examples.

Example 1

Figure 1:
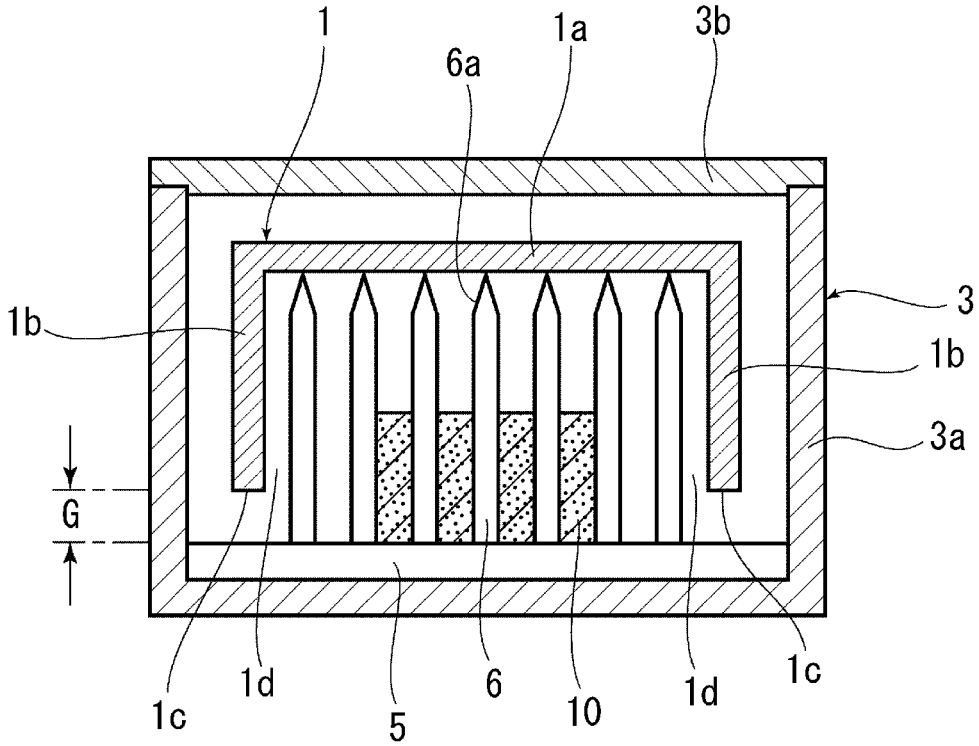
FIG. 1 is a cross-sectional view for illustrating a carburizing method of Example 1 according to the present invention.

FIG. 1 is a cross-sectional view for illustrating a carburizing method in Example 1 according to the present invention.

A tantalum container 1 is set in a chamber 3 formed of a chamber container 3*a* and a chamber lid 3*b*.

Figure 3:
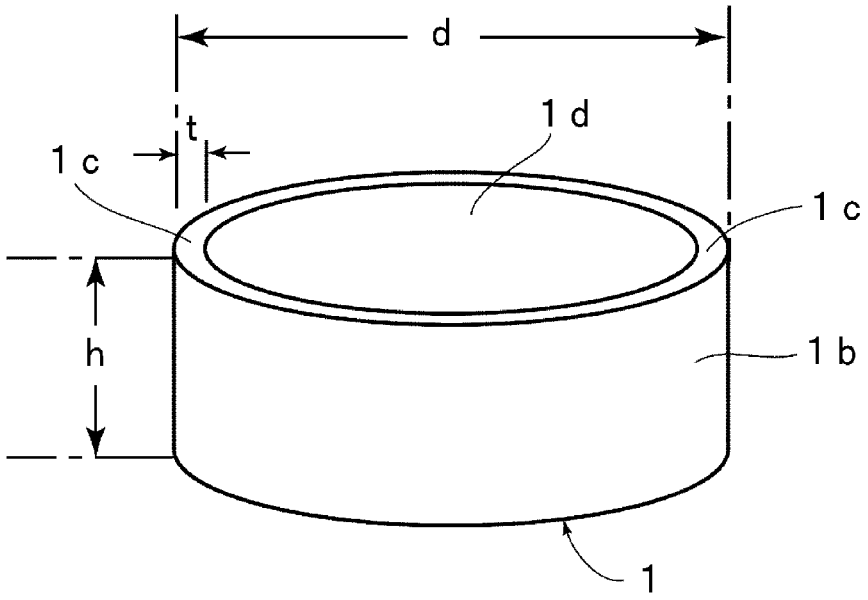
FIG. 3 is a perspective view showing a tantalum container for use in Example 1 shown in FIG. 1.
Figure 4:
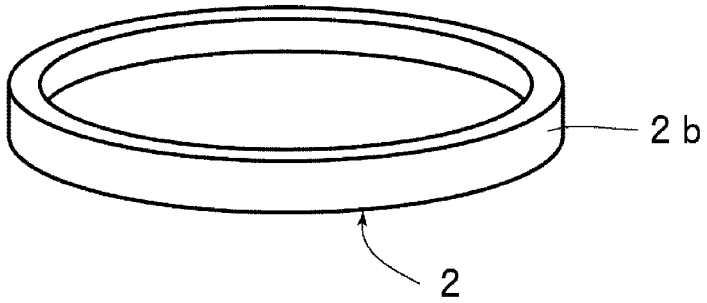
FIG. 4 is a perspective view showing a tantalum lid for use with the tantalum container shown in FIG. 3.

FIG. 3 is a perspective view showing the tantalum container 1. FIG. 4 is a perspective view showing a tantalum lid 2 made of tantalum or a tantalum alloy for use in hermetically closing the tantalum container 1 shown in FIG. 3.

Figure 5:
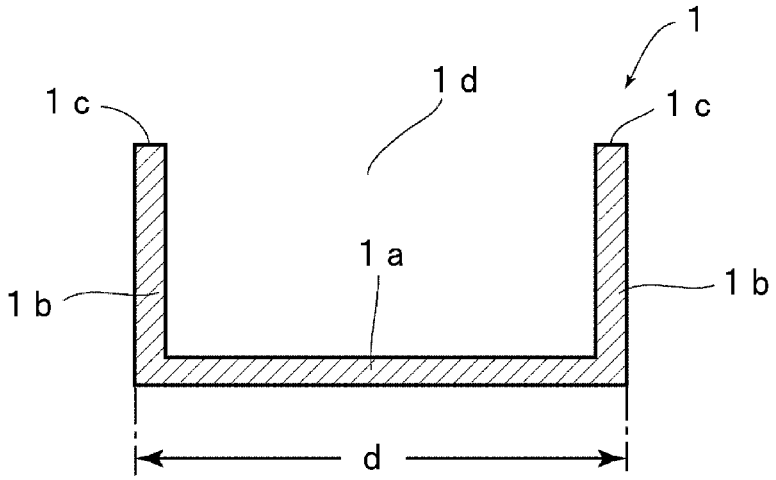
FIG. 5 is a cross-sectional view of the tantalum container shown in FIG. 3.

FIG. 5 is a cross-sectional view showing the tantalum container 1. As shown in FIG. 5, the tantalum container 1 includes a bottom part 1*a* and a sidewall part 1*b* extending from the peripheral edge of the bottom part 1*a* substantially vertically to the bottom part 1*a*. An opening 1*d* of the tantalum container 1 is defined by an end 1*c* of the sidewall part 1*b*. As used herein, the term "substantially vertically" includes directions within 90°±20°.

Figure 6:
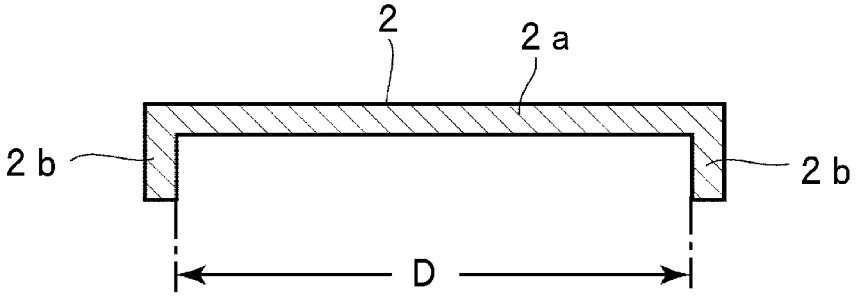
FIG. 6 is a cross-sectional view of the tantalum lid shown in FIG. 4.

FIG. 6 is a cross-sectional view showing the tantalum lid 2 for hermetically closing the opening 1*d* of the tantalum container 1 shown in FIG. 5. As shown in FIG. 6, the tantalum lid 2 includes a top part 2*a* and a sidewall part 2*b* extending substantially vertically from the top part 2*a*.

Figure 7:
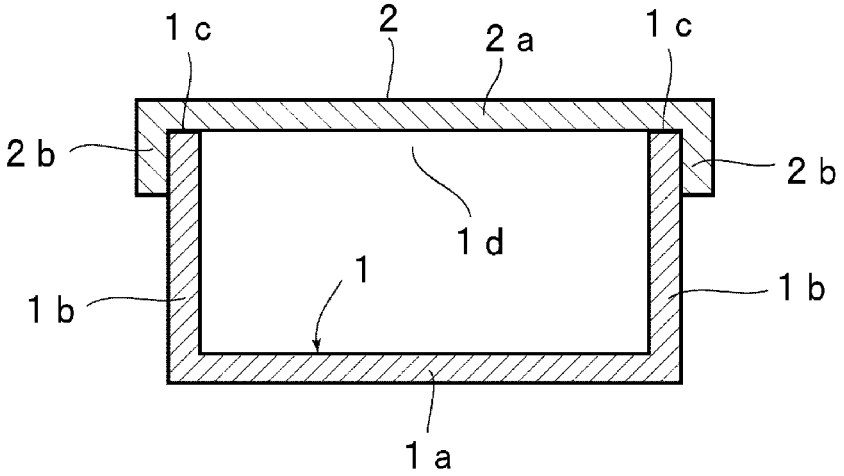
FIG. 7 is a cross-sectional view showing a state that the tantalum lid shown in FIG. 6 is fitted to the tantalum container shown in FIG. 5.

FIG. 7 is a cross-sectional view showing a state that the tantalum lid 2 shown in FIG. 6 is put on the end 1*c* of the sidewall part 1*b* of the tantalum container 1 shown in FIG. 5 to hermetically close the tantalum container 1. As shown in FIG. 7, the sidewall part 1*b* of the tantalum container 1 is placed on the inside of the sidewall part 2*b* of the tantalum lid 2, so that the tantalum lid 2 is put on the tantalum container 1 to hermetically close the tantalum container 1.

As shown in FIG. 7, since the sidewall part 1*b* of the tantalum container 1 is located on the inside of the sidewall part 2*b* of the tantalum lid 2, the inside diameter D of the sidewall part 2*b* of the tantalum lid 2 shown in FIG. 6 is designed to be slightly greater than the outside diameter d of the tantalum container 1 shown in FIG. 5. Normally, the inside diameter D of the tantalum lid 2 is designed to be about 0.1 mm to about 4 mm greater than the outside diameter d of the tantalum container 1.

The tantalum container 1 and the tantalum lid 2 are made of tantalum or a tantalum alloy. The tantalum alloy is an alloy containing tantalum as a major component, and examples thereof include alloys in which tungsten or niobium is contained in tantalum metal.

The tantalum container 1 and the tantalum lid 2 are produced, for example, by machining, drawing from a sheet, or sheet-metal processing. Machining is a processing method in which a single tantalum metal blank is machined in the form of a container. Although it can yield high-precision shapes, it produces large amounts of metal cut away, resulting in increased material cost. Drawing is a processing method in which a single tantalum metal sheet is deformed into the shape of a container in one step. A sheet of metal is placed between a die and a punch for producing a container and the punch is then pushed in toward the die, so that the sheet material is deformed into a container shape in such a manner as to be pressed into the die. A blank holder is previously set in order that while the metal sheet is pressed in, a portion of the metal sheet located outside the die will not be wrinkled. As compared to machining, drawing can finish in a shorter period of time and produces less filings, resulting in reduced cost. Sheet-metal processing is a processing method in which a single metal sheet is formed into the shape of a container by cutting, bending, and welding it. In this case, the cost for material can be reduced as compared to machining, but the production time is longer than that of drawing.

Each of the tantalum container 1 and tantalum lid 2 is carburized to allow carbon to penetrate it from its surface toward its inside, so that the carbon can be diffused into the inside. The penetration of carbon causes the formation of a $Ta_2C$ layer, a TaC layer, or the like. A tantalum carbide layer with a high carbon content is first formed on the surface of the container. Since carbon is then diffused into the inside of the container, the container surface is turned into a tantalum carbide layer with a high tantalum content, which permits further storage of carbon. Therefore, by carrying out liquid phase growth or vapor phase growth of silicon carbide in a crucible formed of a carburized tantalum container and a carburized tantalum lid, carbon vapor generated during the growth process can be stored in the crucible wall, so that a low impurity concentration silicon atmosphere can be formed in the crucible, the occurrence of defects in the surface of a resultant single crystal silicon carbide layer can be reduced, and the surface can be planarized. Furthermore, by thermally annealing the surface of a single crystal silicon carbide substrate in such a crucible, the occurrence of defects can be reduced and the surface can be planarized.

Referring back to FIG. 1, a carburizing treatment in this example is described.

As shown in FIG. 1, the above-described tantalum container 1 is set in the chamber 3 formed of the chamber container 3*a* and the chamber lid 3*b*. The tantalum container 1 is set in the chamber 3 to face the end 1*c* of the sidewall part 1*b* downward. The tantalum container 1 is supported in the chamber 3 by supporting the bottom part 1*a* of the tantalum container 1 from the inside on a plurality of support rods 6.

As shown in FIG. 1, the distal ends 6*a* of the support rods 6 are tapered so that their diameter diminishes toward the extremity. By tapering the distal ends 6*a*, the contact area between the distal ends 6*a* of the support rods 6 and the bottom part 1*a* of the tantalum container 1 can be made small. In this example, the contact area between the distal end 6*a* of each support rod 6 and the bottom part 1*a* is 0.28 $mm^2$. The contact area of the distal end 6*a* is preferably within the range of 0.03 to 12 $mm^2$, more preferably within the range of 0.1 to 8 $mm^2$, and still more preferably within the range of 0.2 to 5 $mm^2$.

Carbon for use in carburization of the tantalum container is produced from the surface of a carbon source. Therefore, the carbon source is preferably placed in the vicinity of the side surface of the tantalum container to face the sidewall of the tantalum container. However, even if a large amount of carbon source is placed in the vicinity of a portion of the tantalum container hard to carburize, reduction in the space for diffusion of carbon between the tantalum container and the carbon source would not provide a significant improvement in rate of carburization. The reason for this can be that at the site where the tantalum container is in contact with the carbon source, the production of carbon is suppressed and the supply of carbon produced at the other sites is blocked by the carbon source. Therefore, by securing the space for diffusion of carbon between the tantalum container and the carbon source, the carburizing treatment can be more efficiently promoted.

The carbon source to be placed in the vicinity of the portion hard to carburize is more preferably a carbon source having continuous open pores as described previously. The expression "having continuous open pores" herein refers to a porous material (for example, a carbon foam) in which open pores continue inside the carbon source. The reason for the preference is that the above carbon source has a larger surface area for producing carbon and a larger number of pores for diffusion of carbon than other carbon sources having the same volume. With the use of a carbon source having continuous open pores, the amount of carbon source placed in the vicinity of the portion hard to carburize can achieve at least a desired rate of carburization as compared to, for example, a carbon source used for the chamber inside wall, such as graphite.

As shown in FIG. 1, carbon foams 10 are placed, between the support rods 6, as the carbon sources having continuous open pores in the present invention.

Figure 2:
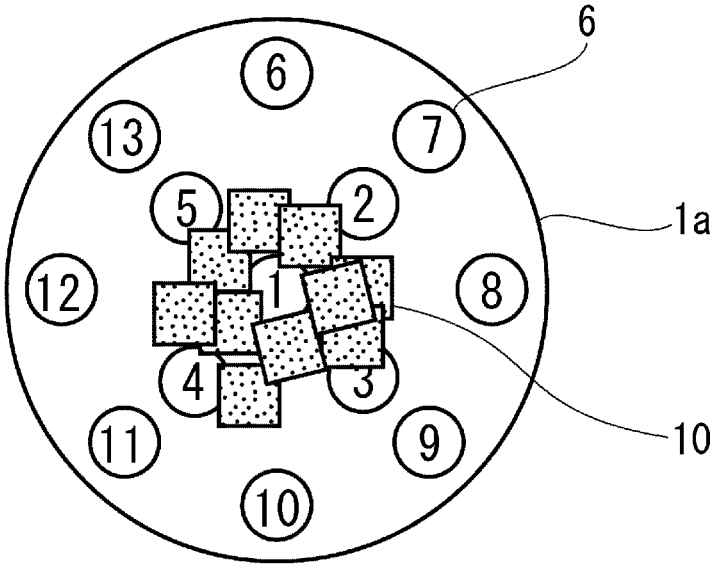
FIG. 2 is a plan view showing the positions of carbon foams and support rods in Example 1 shown in FIG. 1.

FIG. 2 is a plan view showing an arrangement state of the carbon foams 10 and the support rods 6. As shown in FIG. 2, the thirteen support rods 6 are evenly distributed with respect to the bottom part 1*a*.

The carbon foams 10 are arranged to get caught between the support rod 6 designated at 1 and the four support rods 6 designated at 2 to 5.

The carbon foam 10 in this example is formed of reticulated vitreous carbon (RVC). RVC is commercially available, such as from ERG Materials And Aerospace Corporation. RVC is produced by a method of firing a polyurethane resin foam to carbonize it.

No particular limitation is placed on the carbon foam for use in the present invention so long as it is made of a carbon material and can be used as a carbon source having continuous open pores. The preferred material for use as such a carbon source having continuous open pores is vitreous carbon. Known examples of the vitreous carbon include those obtained, such as by a method of firing a resin foam such as of polyurethane resin, melamine resin or phenol resin, a method using a hardened material of phenol resin or furan resin, or a method of producing vitreous carbon from a C/C composite precursor. In the present invention, such vitreous carbon having continuous open pores can be used as the carbon foam.

The carbon foams 10 used in Example 1 are formed of RVC as described previously and have the shape of a column (30 mm long by 30 mm wide by 25 mm high). The carbon foams 10 used in this example, as shown in FIG. 2, are arranged around the support rod 6 designated at 1 to get caught between this support rod 6 and the support rods 6 designated at 2 to 5. FIG. 2 schematically shows the state of the carbon foams 10.

RVC used was one having a density grade of 80 PPI. In this example, ten columnar carbon foams 10 were used.

As shown in FIG. 2, the thirteen support rods 6 are distributed so that the distal ends of the support rods 6 substantially evenly support the bottom part 1*a* of the tantalum container 1 from the inside. In the present invention, the plurality of support rods 6 are preferably distributed so that the distal ends 6*a* of the support rods 6 substantially evenly support the entire bottom part 1*a* of the tantalum container 1. Thus, the deformation of the tantalum container 1 due to the carburizing treatment can be reduced and the flatness of the bottom part can be improved. Particularly, the bottom part 1*a* is preferably supported by one or more support rods per 1500 $mm^2$ of the area of the bottom part.

The support rods 6 are supported by a support base 5, as shown in FIG. 1. In this example, the support base 5 is formed with holes and the lower ends of the support rods 6 are inserted in the holes, whereby the support rods 6 are supported by the support base 5. The support rods 6 and the support base 5 constitute a support member in the present invention.

In this example, the chamber 3, i.e., the chamber container 3*a* and the chamber lid 3*b*, are made of graphite. Therefore, in this example, the chamber 3 is a main carbon source.

In the case of using the chamber as a carbon source, the chamber can serve as a carbon source with the use of, for example, a chamber in which at least the surface is made of graphite. Because the chamber will be thermally treated at high temperatures, the preferred graphite for use is an isotropic graphite material. More preferred is a high-purity graphite material obtained by subjecting graphite to a high purity treatment using a halogen-containing gas or the like. The ash content in the graphite material is preferably 20 ppm or less, more preferably 5 ppm or less. Its bulk density is preferably 1.6 or more, more preferably 1.8 or more. The upper limit of the bulk density is 2.1, for example. An example of a method for producing an isotropic graphite material is as follows. Petroleum coke or coal coke serving as a filler is ground to particles of a few micrometers to tens of micrometers in diameter, a binder, such as pitch, coal tar or coal tar pitch, is added to the filler, followed by kneading of them. The resultant kneaded product is ground to particles of a few micrometers to tens of micrometers in diameter to have a greater ground particle size than the filler as a base material, thereby obtaining a ground product. It is preferred that particles of over 100 μm in diameter should be removed. The ground product is formed, fired, and graphitized to produce a graphite material. Thereafter, the graphite material is subjected to a high purity treatment using halogen-containing gas or the like to give an ash content of 20 ppm or less in the graphite material, whereby it can be prevented that impurity elements are mixed from the graphite material into the tantalum container.

The carbon foams 10 are also subjected to the high purity treatment in the same manner as above. In the present invention, the carbon source to be placed toward the portion hard to carburize should also preferably be subjected to the high purity treatment.

The size and shape of the chamber 3 are preferably selected so that the clearance between the outside surface of the container 1 and the chamber 3 is substantially even as a whole. The clearance between the outside surface of the container 1 and the chamber 3 is preferably within the range of 5.0 to 50 mm. Thus, the distance of the container 1 from the chamber serving as a carbon source can be substantially equal as a whole, so that the outside surface of the container 1 can be entirely uniformly carburized.

In addition, a clearance G is preferably formed below the end 1*c* of the sidewall part 1*b* of the tantalum container 1. The formation of the clearance G enables carbon to be supplied also to the inside surface of the tantalum container 1 from outside the tantalum container 1. The clearance G is preferably within the range of 2 mm to 20 mm. If the clearance is too small, a sufficient amount of carbon may not be able to be supplied to the inside surface of the tantalum container, so that the carburizing treatment of the inside surface of the tantalum container may be insufficient. Furthermore, if the clearance is too large compared to the above upper limit, an effect due to increase in the clearance beyond the upper limit cannot be obtained.

In this example, the support rods 6 and the support base 5 are made of isotropic graphite. Therefore, the support rods 6 and the support base 5 are also main carbon sources. It is only necessary in the present invention that the support member be at least partly a carbon source, as described above. For example, only the support rods 6 may be carbon sources.

After in the above manner the tantalum container 1 is set in the chamber 3, the pressure inside the chamber 3 is reduced and the interior of the chamber 3 is then heated, so that the tantalum container 1 can be carburized.

For example, the pressure inside the chamber 3 can be reduced by placing the chamber 3 in a vacuum vessel, closing the vacuum vessel, and evacuating the vacuum vessel. The pressure inside the chamber 3 is reduced, for example, to 10 Pa or below.

Next, the interior of the chamber 3 is heated to a predetermined temperature. The heating temperature is preferably within the range of 1700° C. or above, more preferably within the range of 1750° C. to 2500° C., and still more preferably within the range of 2000° C. to 2200° C. When heated to such a temperature, the interior of the chamber 3 generally reaches a pressure of about $10^{-2}$ Pa to about 10 Pa.

The time for which the predetermined temperature is held is preferably within the range of 0.1 to 8 hours, more preferably within the range of 0.5 to 5 hours, and still more preferably within the range of 1 to 3 hours. Because the rate of carburization varies depending on the temperature to be held, the holding time is adjusted depending on a desired carburization thickness.

Although no particular limitation is placed on the rate of temperature rise and the cooling rate, the rate of temperature rise is generally preferably within the range of 100 degree C./hour to 2000° C./hour, more preferably within the range of 300° C./hour to 1500° C./hour, and still more preferably within the range of 500° C./hour to 1000° C./hour. The cooling rate is preferably within the range of 40 degree C./hour to 170° C./hour, more preferably within the range of 60° C./hour to 150° C./hour, and still more preferably within the range of 80° C./hour to 130° C./hour. The cooling is generally implemented by natural cooling.

A tantalum container 1 was carburized using a chamber 3 shown in FIG. 1. The tantalum container 1 used was one shown in FIG. 3 and having an outside diameter d of 158 mm, a height h of 60 mm, and a thickness t of 3 mm. Therefore, the inside diameter of the bottom part 1*a* on the inside of the tantalum container 1 is 152 mm and the area thereof is 18136 $mm^2$.

In this example, as shown in FIG. 2, thirteen support rods 6 were arranged with respect to the bottom part 1*a*. Therefore, the bottom part 1*a* was supported by the support rods 6, one per 1395 $mm^2$ of the area of the bottom part 1*a*.

The chamber 3 used was a chamber 3 whose interior is a columnar space measuring 210 mm in diameter and 90 mm high. The material used for the chamber container 3*a* and the chamber lid 3*b* was an isotropic graphite material with a bulk density of 1.8.

The support rods 6 used were those measuring 6 mm in diameter and 75 mm long. The length of the tapered portion of the distal end 6*a* was 15 mm. The contact area of the distal end 6*a* was 0.28 $mm^2$. The material used for the support rods 6 and the support base 5 was an isotropic graphite, like the above.

The clearance G below the end 1*c* of the sidewall part 1*b* of the tantalum container 1 was 13 mm.

Figure 19:
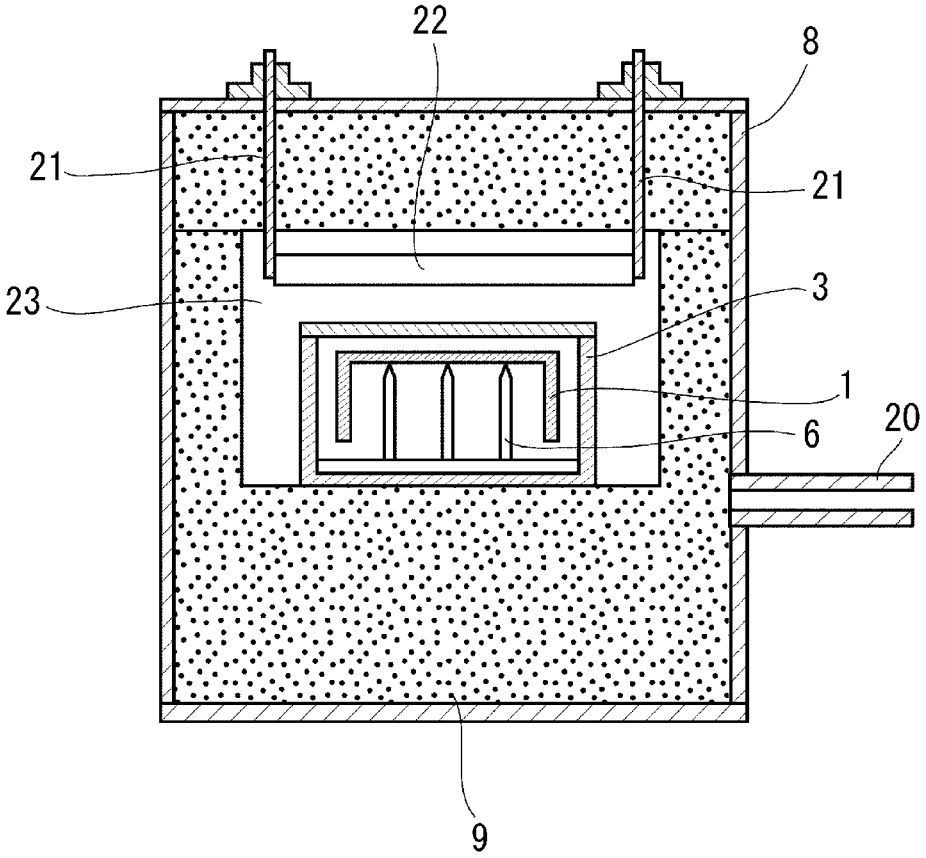
FIG. 19 is a cross-sectional view for illustrating a carburizing treatment in Example 1 according to the present invention.

The tantalum container 1 was set in the chamber 3 in the above manner, and the chamber 3 was then placed in a vacuum vessel 8 measuring 800 mm in diameter by 800 mm high and made of SUS stainless steel. FIG. 19 is a cross-sectional view showing a state that the chamber 3 is placed in the vacuum vessel 8. As shown in FIG. 19, a heat insulating material 9 is provided in the vacuum vessel 8. The chamber 3 was placed in a space 23 formed in the heat insulating material 9. The heat insulating material 9 used was a material having a trade name "DON-1000" (with a bulk density of 0.16 g/cm$^3$, manufactured by Osaka Gas Chemicals Co., Ltd.). This heat insulating material is a material obtained by impregnating pitch-based carbon fibers with resin, molding, curing, carbonizing, and graphitizing the fibers and is therefore a porous heat insulating material.

A carbon heater 22 is disposed in an upper part of the space 23 surrounded by the heat insulating material 9, and the carbon heater 22 is supported by graphite electrodes 21 for passing electric current through the carbon heater 22. By passage of electric current through the carbon heater 22, the space 23 enclosed by the heat insulating material 9 can be heated.

The vacuum vessel 8 has an exhaust outlet 20 formed to evacuate the vacuum vessel 8 therethrough. The exhaust outlet 20 is connected to an unshown vacuum pump.

The vacuum vessel 8 was evacuated to reduce the pressure inside the chamber 3 to 0.1 Pa or below, and the interior of the chamber 3 was then heated to 2150° C. at a rate of temperature rise of 710° C./hour by the carbon heater 22. A carburizing treatment was performed by holding 2150° C. for two hours. The interior of the chamber 3 was at a pressure of about 0.5 to about 2.0 Pa.

After the carburizing treatment, the chamber interior was cooled to room temperature by natural cooling. The cooling time was approximately 15 hours.

The tantalum container 1 after the carburizing treatment was determined in terms of thicknesses of a carburized layer on the inside surface and outside surface in the following manner.

The thickness of the carburized layer was calculated by obtaining a measured value (μm) from the amplitude and phase of an eddy current induced by a high-frequency electric field produced by a probe using Elcometer 456 manufactured by Elcometer Limited and multiplying the measured value by a factor of 6.9 to convert it into a thickness of the carburized layer made of TaC. The factor of 6.9 was derived from a correlation between values calculated by Elcometer 456 and actual measured values of cross sections.

Figure 8:
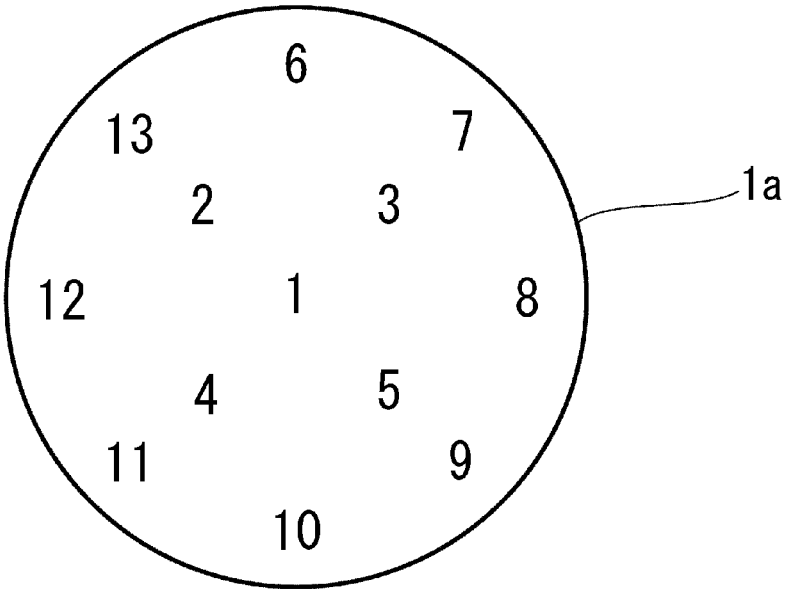
FIG. 8 is a plan view showing measurement points of the bottom part of the tantalum container at which the carburization thickness is to be measured.
Figure 9:
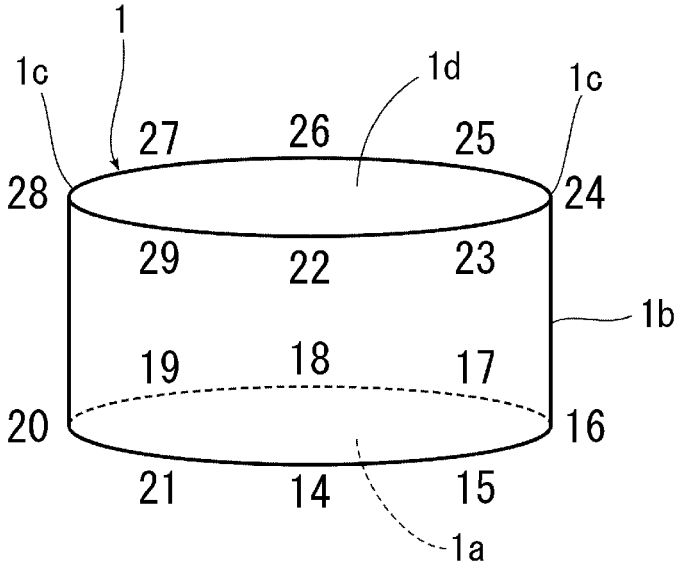
FIG. 9 is a perspective view showing measurement points of the sidewall part of the tantalum container at which the carburization thickness is to be measured.

FIG. 8 is a plan view showing measurement points of the bottom part 1*a* of the tantalum container 1. FIG. 9 is a perspective view showing measurement points of the sidewall part 1*b* of the tantalum container 1 at which the thickness of the carburized layer is to be measured.

Figure 10:
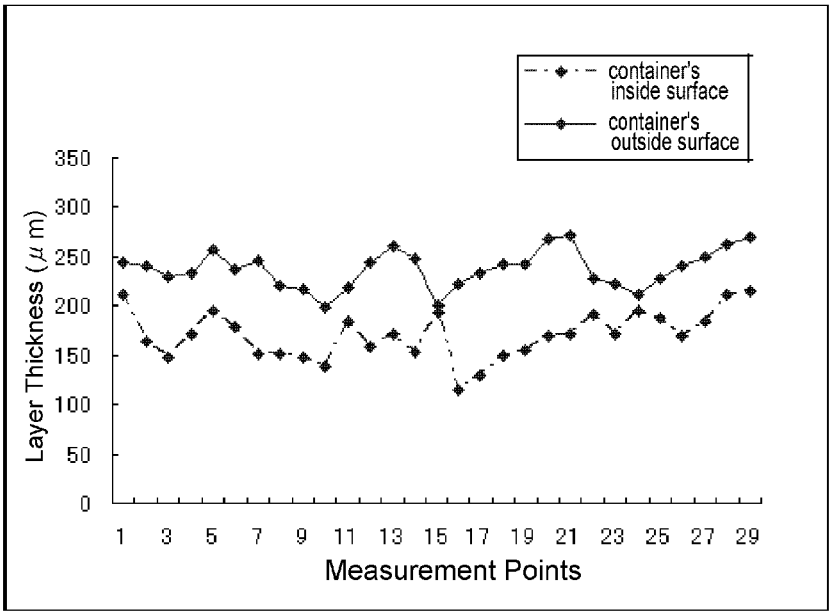
FIG. 10 is a graph showing the thicknesses of a carburized layer at the measurement points of the inside and outside surfaces of the tantalum container in Example 1 according to the present invention.

FIG. 10 is a graph showing the thicknesses of the carburized layer at the measurement points in this example. The dash-single-dot line in FIG. 10 shows the thicknesses of the carburized layer on the inside surface of the tantalum container 1 and the solid line therein shows the thicknesses of the carburized layer on the outside surface of the tantalum container 1. The measurement points designated at 1 to 13 in FIG. 10 represent the measurement points of the bottom part 1*a* as shown in FIG. 8. The measurement points designated at 14 to 21 in FIG. 10 represent the measurement points of the sidewall part 1*b* near the bottom part 1*a* as shown in FIG. 9 and the measurement points designated at 22 to 29 represent the measurement points of the sidewall part 1*b* near the opening 1*d*.

As shown in FIG. 10, in this example, the tantalum container was carburized so that the inside and outside surfaces had nearly equal carburized layer thicknesses.

Comparative Example 1

Figure 11:
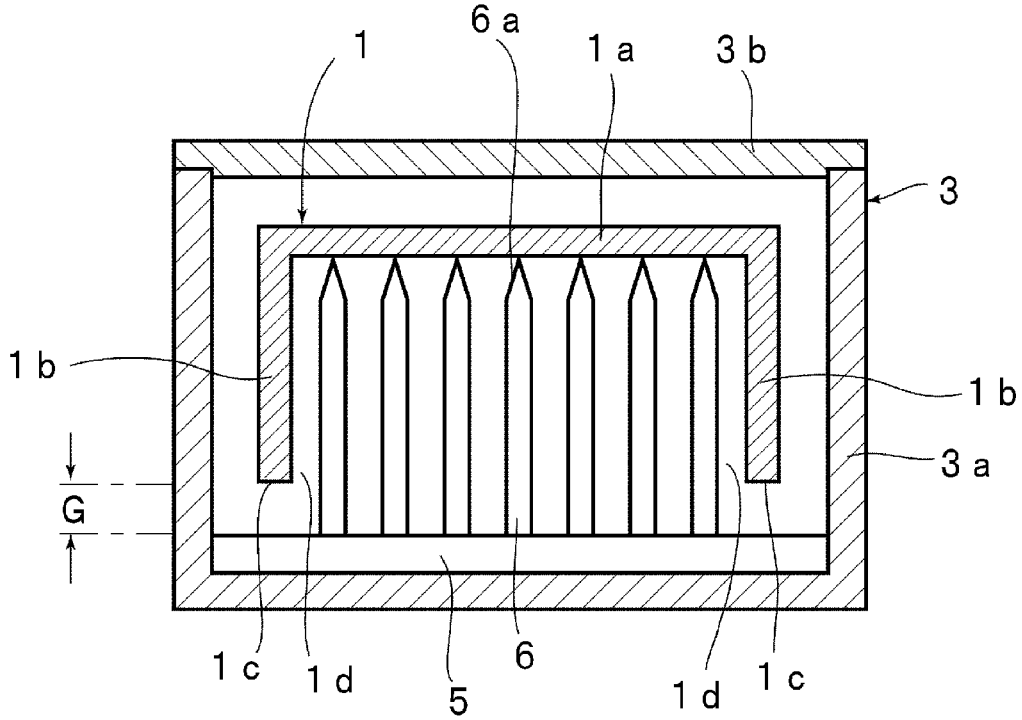
FIG. 11 is a cross-sectional view for illustrating a carburizing method in Comparative Example 1.

FIG. 11 is a cross-sectional view for illustrating a carburizing method in Comparative Example 1.

As shown in FIG. 11, in this comparative example, a tantalum container 1 was carburized in the same manner as in Example 1 above except that no carbon foam 10 was placed in the chamber 3.

Figure 12:
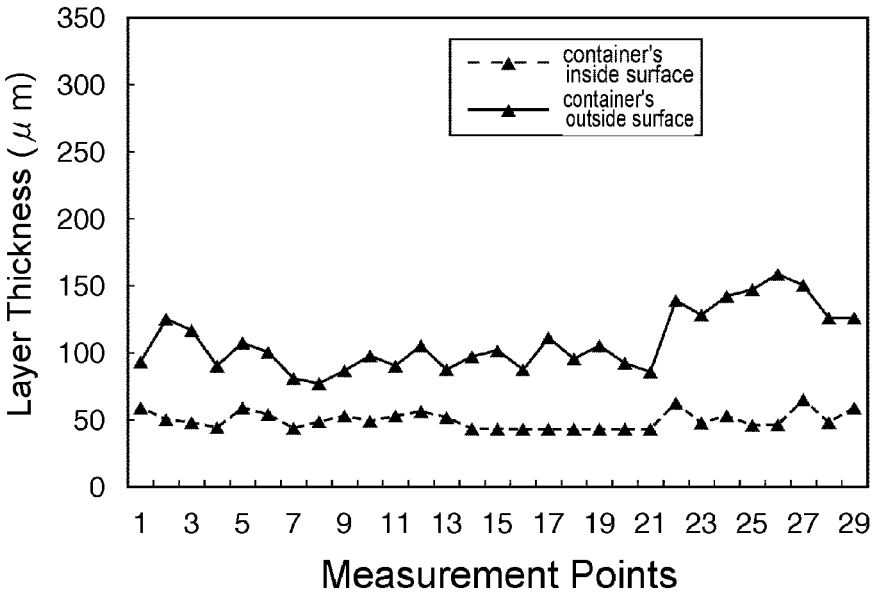
FIG. 12 is a graph showing the thicknesses of a carburized layer at the measurement points of the inside and outside surfaces of a tantalum container in Comparative Example 1.

FIG. 12 is a graph showing the thicknesses of a carburized layer after the carburizing treatment in this comparative example. The dashed line shown in FIG. 12 shows the thicknesses of the carburized layer on the inside surface of the tantalum container and the solid line therein shows the thicknesses of the carburized layer on the outside surface of the tantalum container.

As shown in FIG. 12, in this comparative example in which no carbon foam was placed as a carbon source in the chamber 3, the thickness of the carburized layer on the inside surface of the tantalum container 1 was small, which shows that the carburizing treatment was not sufficiently made.

Since in Example 1 carbon foams 10 serving as carbon sources are placed inwardly of the opening 1*d* of the tantalum container 1, carbon can be supplied from the carbon foams 10 to the inside surface of the tantalum container 1. Therefore, the carburizing treatment of the inside surface of the tantalum container 1 can be promoted, so that the inside surface of the tantalum container 1 can be carburized as well as the outside surface of the tantalum container 1.

Example 2

Figure 13:
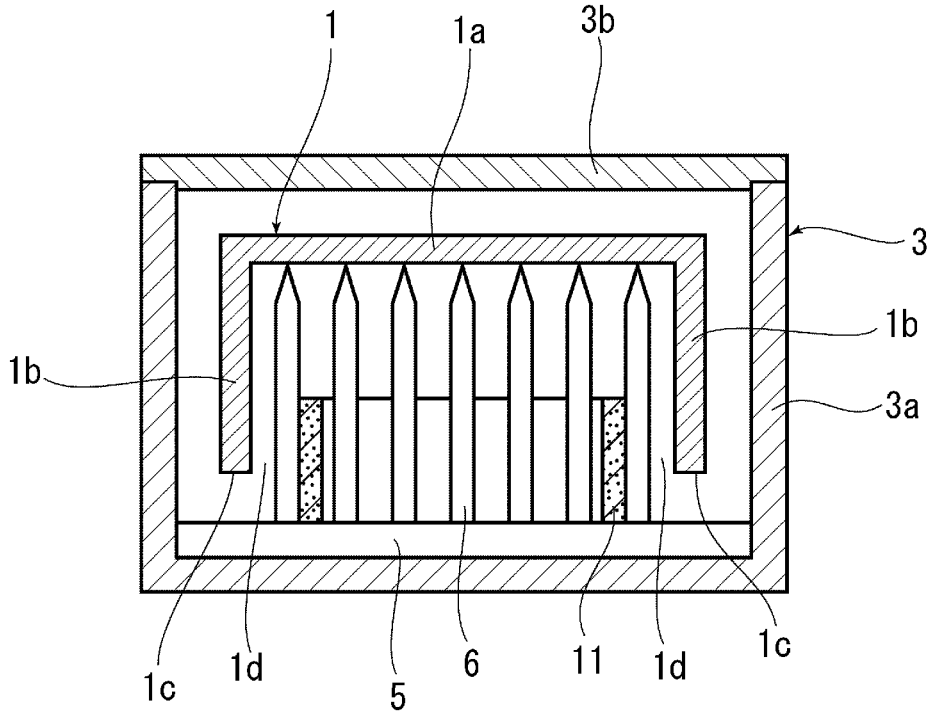
FIG. 13 is a cross-sectional view for illustrating a carburizing method in Example 2 according to the present invention.

FIG. 13 is a cross-sectional view for illustrating a carburizing method in Example 2 according to the present invention. As shown in FIG. 13, in this example, a cylindrical carbon foam 11, instead of columnar carbon foams 10, is placed in the chamber 3.

The cylindrical carbon foam 11 used was one having an outside diameter of 180 mm, an inside diameter of 140 mm, and a height of 25 mm.

Figure 14:
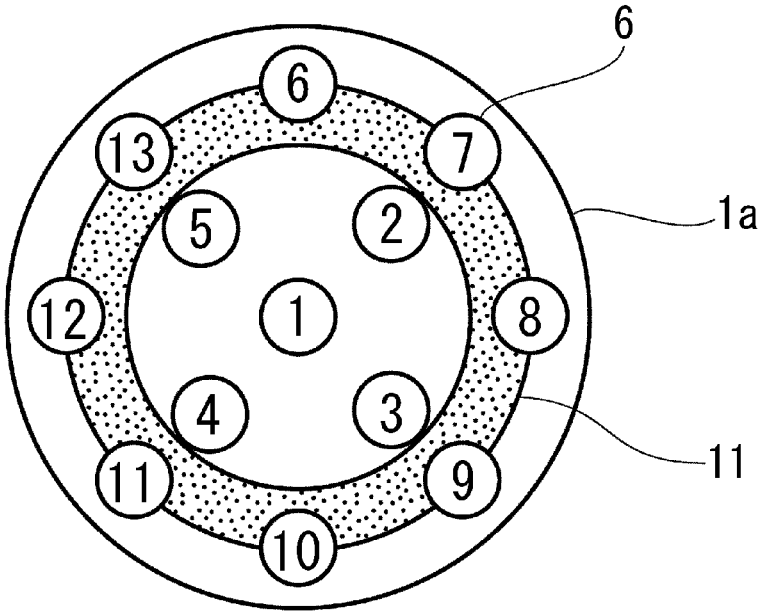
FIG. 14 is a plan view showing the positions of a carbon foam and support rods in Example 2 shown in FIG. 13.

FIG. 14 is a plan view showing an arrangement state of the carbon foam 11 in Example 2 shown in FIG. 13.

As shown in FIG. 14, the cylindrical carbon foam 11 is placed in the chamber 3 by putting and sticking it on the distal ends of the support rods 6 designated at 6 to 13 and then moving it down. The carbon foam 11 is made of the same material as the columnar carbon foams 10 in Example 1 above.

Figure 15:
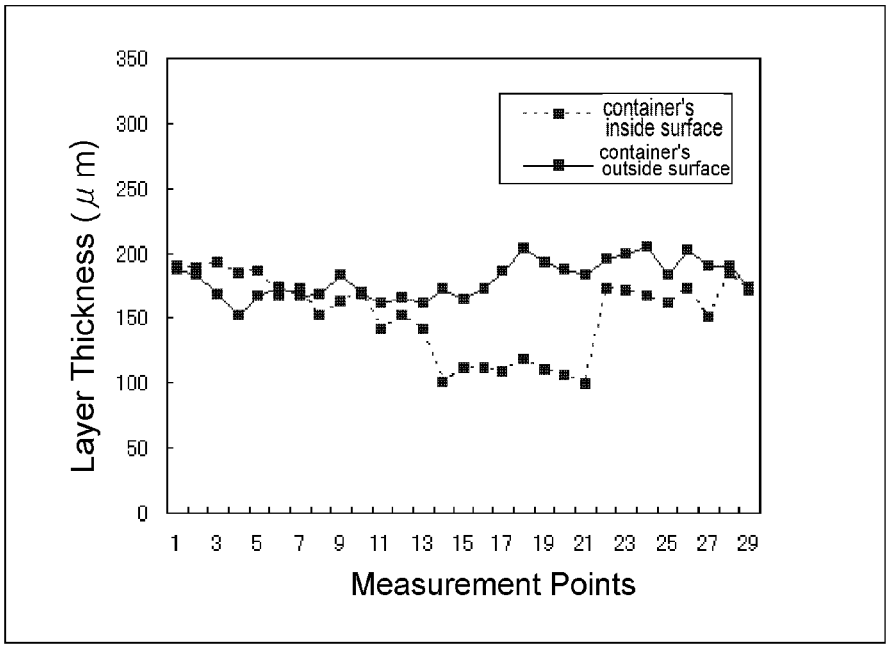
FIG. 15 is a graph showing the thicknesses of a carburized layer at the measurement points of the inside and outside surfaces of a tantalum container in Example 2 according to the present invention.

FIG. 15 is a graph showing the thicknesses of a carburized layer at the measurement points in this example.

As shown in FIG. 15, it can be seen that as compared to Comparative Example 1, the inside surface of the tantalum container 1 was carburized as well as the outside surface of the tantalum container 1.

As compared to Example 1 (FIG. 10), the thickness of the carburized layer is greater on the inside surface of the bottom part 1*a* of the tantalum container 1 (at the measurement points designated at 1 to 13) and on a portion of the inside surface of the sidewall part 1*b* of the tantalum container 1 near the opening 1*d* (at the measurement points designated at 22 to 29). This can be attributed to the fact that in this example the cylindrical carbon foam 11 was used and placed near the sidewall part 1*b* of the tantalum container 1 and along the sidewall part 1*b*.

In contrast, as seen from FIG. 15, the thickness of the carburized layer is smaller on a portion of the inside surface of the sidewall part 1*b* of the tantalum container 1 near the bottom part 1*a* thereof (at the measurement points designated at 14 to 21) than on the other portions. The reason for this can be that the portion of the inside surface of the sidewall part 1*b* of the tantalum container 1 near the bottom part 1*a* thereof was a portion less likely to be supplied with carbon and therefore hard to carburize.

Example 3

Figure 16:
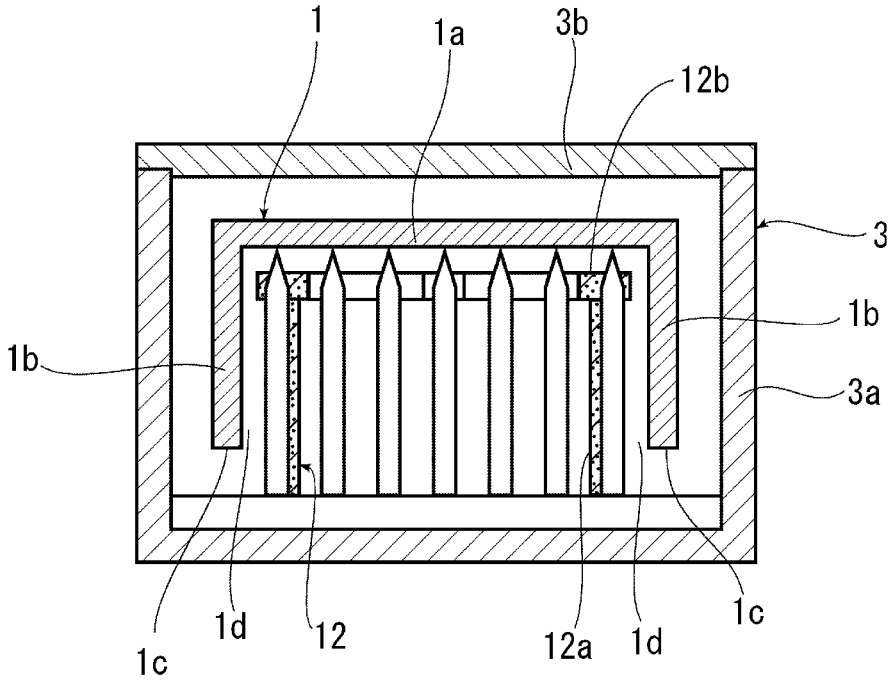
FIG. 16 is a cross-sectional view for illustrating a carburizing method in Example 3 according to the present invention.

FIG. 16 is a cross-sectional view for illustrating a carburizing method in Example 3 according to the present invention. In this example, a carbon foam 12 shown in FIG. 16 is placed in the chamber 3.

Figure 17:
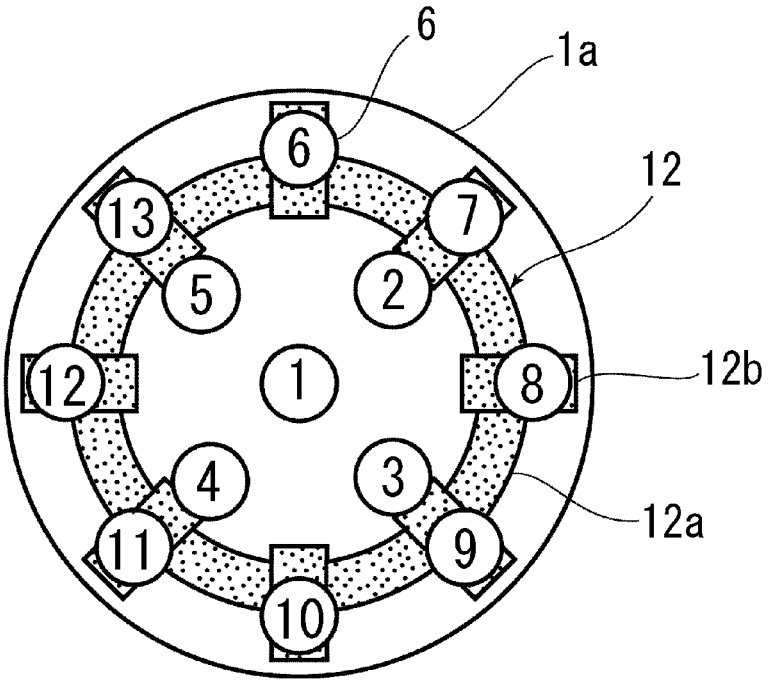
FIG. 17 is a plan view showing the positions of a carbon foam and support rods in Example 3 shown in FIG. 16.

FIG. 17 is a plan view showing an arrangement state of the carbon foam 12 with respect to the bottom part 1*a*. As shown in FIG. 17, the carbon foam 12 in this example is composed of a cylindrical carbon foam 12*a* and columnar carbon foams 12*b* placed on top of the cylindrical carbon foam 12*a*. As shown in FIG. 17, the columnar carbon foams 12*b* are placed by sticking them on and pressing them down onto eight support rods 6 designated at 6 to 13, one columnar carbon foam for each support rod. Therefore, eight columnar carbon foams 12*b* are used. The carbon foam 12*b* measures 30 mm long, 20 mm wide, and 10 mm high.

The carbon foam 12*a* is a cylindrical carbon foam and measures 180 mm in outside diameter, 40 mm in inside diameter, and 50 mm high.

First, the cylindrical carbon foam 11 is placed on top of the distal ends of the support rods 6 designated at 6 to 13, stuck on them, and then moved down. Next, columnar carbon foams 12*b* are placed, one on each of the distal ends of the support rods 6 designated at 6 to 13, stuck on them, and then moved down. Thus, the carbon foam 12 shown in FIGS. 16 and 17 can be formed.

A tantalum container 1 was carburized in the same manner as in Example 1 except that the carbon foam 12 was used instead of the carbon foam 10 in the above manner.

Figure 18:
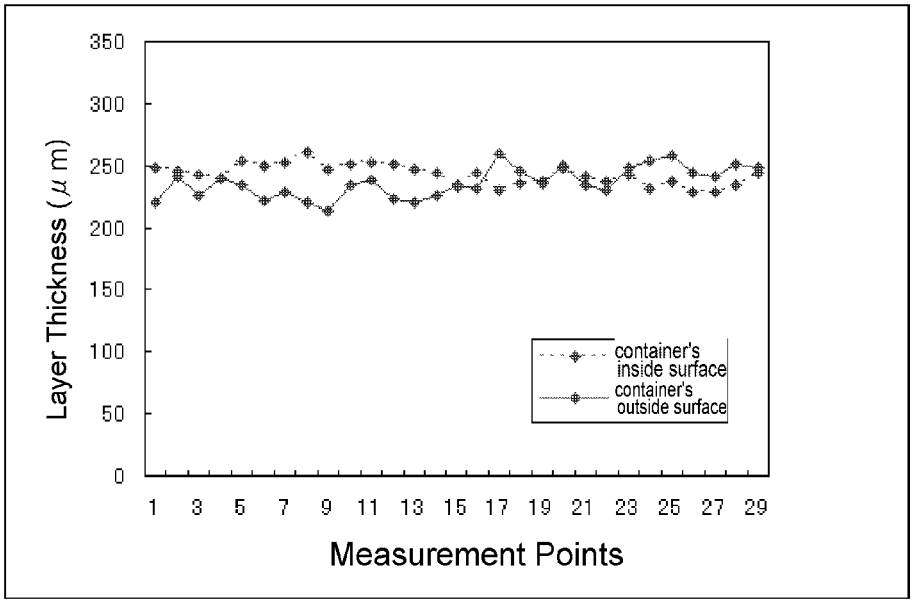
FIG. 18 is a graph showing the thicknesses of a carburized layer at the measurement points of the inside and outside surfaces of a tantalum container in Example 3 according to the present invention.

FIG. 18 is a graph showing the thicknesses of a carburized layer at the measurement points of the inside and outside surfaces of the tantalum container 1.

As shown in FIG. 18, in this example, the tantalum container 1 could be carburized so that the inside and outside surfaces had nearly equal carburized layer thicknesses.

A comparison with Example 2 (FIG. 15) shows that the carburizing treatment is promoted particular on a portion of the inside surface (at the measurement points designated at 14 to 21) of the sidewall part 1*b* of the tantalum container 1 located near the bottom part 1*a* (a corner portion formed by the bottom part 1*a* and the sidewall part 1*b*) and the thickness of the carburized layer on the portion is greater. The reason for this can be that since part of the carbon foam 12 used in this example was placed in the vicinity of the portion of the inside surface of the sidewall part 1*b* of the tantalum container 1 located near the bottom part 1*a* (the corner portion formed by the bottom part 1*a* and the sidewall part 1*b*), the carburizing treatment of that portion of the carbon foam 12 was promoted. In other words, the reason can be that the cylindrical carbon foam 12*a* of the carbon foam 12 was higher than the carbon foam 11 in Example 2 and the columnar carbon foams 12*b* were provided on top of the cylindrical carbon foam 12*a*.

As seen from the above, in the present invention, the thicknesses of the carburized layer on various portions of the tantalum container can be easily controlled by adjusting the arrangement of the carbon foam serving as a carbon source. The clearance between each portion hard to carburize and the carbon source is preferably within the range of 5.0 to 50 mm.

The carbon source for use in the present invention is not limited to the carbon foams used in the above examples and, for example, graphite can be used as the carbon source.

REFERENCE SIGNS LIST

1 . . . tantalum container
1*a* . . . bottom part of tantalum container
1*b* . . . sidewall part of tantalum container
1*c* . . . end of sidewall part of tantalum container
1*d* . . . opening of tantalum container
2 . . . tantalum lid
2*a* . . . top part of tantalum lid
2*d* . . . sidewall part of tantalum lid
3 . . . chamber
3*a* . . . chamber container
3*b* . . . chamber lid
5 . . . support base
6 . . . support rod
6*a* . . . distal end of support rod
7 . . . support rod
8 . . . vacuum vessel made of SUS
9 . . . heat insulating material
10, 11, 12, 12*a*, 12*b* . . . carbon foam
20 . . . exhaust outlet
21 . . . graphite electrode
22 . . . carbon heater
23 . . . space enclosed by heat insulating material

The invention claimed is:

1. A method for carburizing a tantalum container made of tantalum or a tantalum alloy to allow carbon to penetrate the tantalum container, the method comprising the steps of:

supporting the tantalum container on a plurality of support rods provided in a chamber and setting the tantalum container in the chamber; and reducing the pressure inside the chamber and heating the interior of the chamber, wherein a carbon source is placed in the vicinity of a portion of the tantalum container hard to carburize, wherein the tantalum container is formed of a bottom part, a sidewall part, and an opening, and is set in the chamber to face the opening of the tantalum container downward by being supported on the plurality of supporting rods which are in direct contact with the bottom part of the tantalum container from the inside, and wherein the plurality of support rods are made of a carbon source.

2. The method for carburizing the tantalum container according to claim 1, wherein at least an inside wall of the chamber is made of a carbon source.

3. The method for carburizing the tantalum container according to claim 1, further comprising, prior to the step of placing the carbon source in the vicinity of the portion of the tantalum container hard to carburize, the step of reducing the pressure inside the chamber and heating the interior of the chamber to identify in advance the portion of the tantalum container hard to carburize.

4. The method for carburizing the tantalum container according to claim 1, wherein the portion of the tantalum container hard to carburize includes the inside surfaces of the bottom part and the sidewall part of the tantalum container.

5. The method for carburizing the tantalum container according to claim 4, wherein the carbon source is placed in the interior of the tantalum container.

6. The method for carburizing the tantalum container according to claim 1, wherein the portion of the tantalum container hard to carburize is a corner portion thereof formed by the inside surfaces of the bottom part and the sidewall part of the tantalum container and the carbon source is placed in the vicinity of the corner portion.

7. The method for carburizing the tantalum container according to claim 1, wherein the carbon source is a carbon foam.

* * * * *